US011304510B1

(12) United States Patent
Fernandes

(10) Patent No.: US 11,304,510 B1
(45) Date of Patent: Apr. 19, 2022

(54) PORTABLE STANDING DESK

(71) Applicant: Gregory Alan Fernandes, Walled Lake, MI (US)

(72) Inventor: Gregory Alan Fernandes, Walled Lake, MI (US)

( * ) Notice: Subject to any disclaimer, the term of this patent is extended or adjusted under 35 U.S.C. 154(b) by 0 days.

(21) Appl. No.: 17/091,955

(22) Filed: Nov. 6, 2020

(51) Int. Cl.

| | |
|---|---|
| ***A47B 21/02*** | (2006.01) |
| ***A47B 9/20*** | (2006.01) |
| ***A47B 21/04*** | (2006.01) |
| ***A47B 13/16*** | (2006.01) |
| ***A47B 13/08*** | (2006.01) |
| ***A47B 3/10*** | (2006.01) |

(52) U.S. Cl.
CPC ..... *A47B 21/02* (2013.01); *A47B 3/10* (2013.01); *A47B 9/20* (2013.01); *A47B 13/088* (2013.01); *A47B 13/16* (2013.01); *A47B 21/04* (2013.01)

(58) Field of Classification Search
CPC ..... A47B 3/10; A47B 3/12; A47B 5/00
USPC ..... 108/43, 44, 34, 35, 36, 38
See application file for complete search history.

(56) References Cited

U.S. PATENT DOCUMENTS 1,625,294 A 4/1927 Lunsfred
2,598,128 A * 5/1952 Liechty ..... A47B 19/08 108/13
2,759,576 A * 8/1956 Townsend ..... A47B 3/10 190/11
3,074,770 A * 1/1963 Joos ..... A47B 3/083 108/35
4,887,536 A * 12/1989 Teichner ..... A45C 9/00 108/35
4,927,128 A * 5/1990 O'Brian ..... A47B 3/087 108/36
5,265,541 A * 11/1993 Gordon ..... A47B 3/10 108/34
5,660,117 A * 8/1997 Noble ..... A47B 23/043 108/35
6,032,590 A 3/2000 Chen
6,036,011 A * 3/2000 DeCurtis ..... A45C 15/00 190/11
6,192,809 B1 * 2/2001 Riach ..... A47B 3/087 108/115

(Continued)

FOREIGN PATENT DOCUMENTS

GB 2554438 A * 4/2018 ..... B60N 3/004
KR 19980058225 U 10/1998

(Continued)

*Primary Examiner* — Jose V Chen
(74) *Attorney, Agent, or Firm* — RMCK Law Group PLC

(57) ABSTRACT

A portable standing desk configured for use in at least a storage position and a first use position includes a first and second tray portion, and an end cap. The first tray portion can have a main body including a first plurality of fingers, a first plurality of landing surfaces, first hinge posts and first guide arms. The first tray portion has a first working surface and a first inside surface. The second tray portion has a main body including a second plurality of fingers, a second plurality of landing surfaces, second hinge posts and second guide arms. The second tray portion has a second working surface and a second inside surface. The first and second hinge posts couple with the second and first guide arms to form a hinge that defines a pivot axis such that the first and second tray portions are selectively rotatable relative to each other.

20 Claims, 14 Drawing Sheets

(56) References Cited

U.S. PATENT DOCUMENTS 6,289,824 B1 * 9/2001 Parker ..... A47B 1/00 108/115
7,370,908 B2 5/2008 Crowell
7,574,964 B2 * 8/2009 Farber ..... A47B 3/087 108/115
7,707,948 B2 * 5/2010 Lin ..... A47B 3/0911 108/169
8,322,290 B1 * 12/2012 Mignano ..... A47B 23/043 108/9
8,322,292 B2 * 12/2012 Chen ..... A47B 23/043 108/43
8,479,663 B2 * 7/2013 Davis ..... A47B 25/00 108/35
8,584,598 B2 11/2013 Derkoski
9,770,096 B1 * 9/2017 Meyer ..... A47B 3/10
9,848,695 B1 * 12/2017 Gauss ..... A47B 37/04
10,405,645 B1 * 9/2019 Liu ..... A47B 3/087
D913,727 S * 3/2021 Howell ..... D6/655.1
2004/0237849 A1 * 12/2004 Zhurong ..... A47B 3/0912 108/35
2007/0028812 A1 * 2/2007 Dumond ..... A47B 3/087 108/36
2008/0072802 A1 * 3/2008 de Oliveira ..... A47B 3/10 108/12
2009/0078174 A1 * 3/2009 Larcom ..... A47B 3/0815 108/169
2009/0211496 A1 * 8/2009 Davis ..... A47C 4/02 108/50.11
2010/0116174 A1 * 5/2010 Chen ..... A47B 9/14 108/36
2012/0237142 A1 * 9/2012 Derkoski ..... A47B 3/12 383/6
2017/0245608 A1 * 8/2017 King ..... A45C 9/00
2018/0035800 A1 * 2/2018 Okeke ..... A47B 13/16
2019/0254417 A1 8/2019 McKsymick
2019/0318663 A1 10/2019 Ortiz

FOREIGN PATENT DOCUMENTS

KR 20080004080 U 9/2008
KR 20130124841 A 11/2013
KR 101359113 B1 2/2014
WO WO-2017083713 A1 * 5/2017 ..... B25H 1/04

* cited by examiner

PORTABLE STANDING DESK

FIELD

The present disclosure relates generally to a portable standing desk and more particularly to a portable standing desk that is movable between a storage position and a plurality of use positions.

BACKGROUND

The landscape of working and studying remotely has expanded in recent years. Traditional workspaces with fixed large desks and dedicated meeting rooms are becoming less favorable and less convenient. The more efficient worker and student desires portability and convenience to quickly set up a temporary workspace that may be accommodated at many different locations throughout a given week. The ability to quickly mobilize and set up electronic equipment such as a laptop, tablet or phone from one location to another location is valuable in today's remote working and remote learning environment. Moreover, providing a portable desk solution that can be both compact for transportation as well as expandable to accommodate electronic equipment in a useable fashion is becoming increasingly in demand.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A portable standing desk configured for use in at least a storage position and a first use position includes a first tray portion, a second tray portion and an end cap. The first tray portion can have a main body including a first plurality of fingers, a first plurality of landing surfaces, first hinge posts and first guide arms. The first tray portion has a first working surface and a first inside surface. The second tray portion has a main body including a second plurality of fingers, a second plurality of landing surfaces, second hinge posts and second guide arms. The second tray portion has a second working surface and a second inside surface. The first and second hinge posts couple with the second and first guide arms respectively to form a hinge that defines a pivot axis such that the first and second tray portions are selectively rotatable relative to each other about a hinge. The end cap has an end cap body including a series of upper legs and a series of lower legs. The portable standing desk is selectively and alternatively movable between the storage position and the first use position. In the storage position the first tray portion, the second tray portion and the end cap all engage each other and attain a position such that (i) the respective inside surfaces oppose each other, (ii) the first plurality of fingers and the second plurality of landing surfaces oppose the upper legs, and (iii) the second plurality of fingers and the first plurality of landing surfaces oppose the lower legs.

According to additional features, in the first use position, (i) the first plurality of fingers oppose the second plurality of landing surfaces, and (ii) the second plurality of fingers oppose the first plurality of landing surfaces. The end cap can further include a series of detents extending from the lower legs. In the storage position, the series of detents locate into complementary first grooves defined on the first tray portion. The first tray portion can include a series of ramps extending between the first series of tracks and the first grooves. The detents of the end cap slidably traverse along the respective first series of tracks prior to positively locating into the respective first grooves in the storage position. In the first use position, the end cap is located into positive engagement with and extends a distance away from the second tray portion. The upper and lower legs of the end cap oppose the second tray portion. The lower detents positively locate against a support wall extending on the second inside surface of the second tray portion in the first use position.

According to other features, the end cap can define a pocket therein. The pocket is configured to receive and orient in an upright position at least one of a personal electronic device and a clipboard thereat. The first tray portion can further define a plurality of coupling channels formed on the first plurality of fingers and a first plurality of engaging tabs formed on the first plurality of landing surfaces. The second tray portion can further define a second plurality of coupling channels formed on the second plurality of fingers and a second plurality of engaging tabs formed on the second plurality of landing surfaces. In the first use position, (i) the first plurality of engaging tabs locate into the second plurality of coupling channels causing an interference fit therebetween, and (ii) the second plurality of engaging tabs locate into the first plurality of coupling channels causing an interference fit therebetween. The end cap defines windows formed on the upper and lower legs. The windows are configured to accommodate the first and second plurality of engaging tabs in the storage position.

In other features, the first and second tray portions both define first and second pairs of blind bores therein. The first blind bores are configured to selectively receive support legs in the first use position. The second tray portion is configured to receive support legs at the first and second pairs of blind bores in a second use position whereby only the second tray portion is supported in an upright position while the first tray portion is rotated about the hinge into a generally upright position.

According to other features, the portable desk can further include an accessory tray that is received in a first tray pocket in the storage position and selectively coupled to the first tray portion in the first use position. A beverage tray assembly can be received in the second tray pocket in the storage position and selectively coupled to the second tray portion in the first use position. A pair of angling blocks can be received in the first tray pocket in the storage position and selectively coupled to the first tray portion in the first use position, the pair of angling blocks configured to raise an orientation of a personal electronic device that is placed on the first working surface. At least one stop can be received in the first tray pocket in the storage position and selectively coupled to the first tray portion in the first use position, the at least one stop configured to inhibit sliding of the personal electronic device relative to the first working surface.

A portable standing desk configured for use in at least a storage position and a first use position includes a first tray portion, a second tray portion and an end cap. The first tray portion can have a main body including a first plurality of fingers that define a respective first plurality of coupling channels, a first plurality of landing surfaces that include a respective first plurality of engaging tabs, first hinge posts and first guide arms, the first tray portion having a first working surface and a first inside surface. The second tray portion can have a main body including a second plurality of fingers that define a respective second plurality of coupling channels, a second plurality of landing surfaces that include a respective second plurality of engaging tabs, second hinge posts and second guide arms, the second tray portion having a second working surface and a second inside surface, wherein the first and second hinge posts couple with the second and first guide arms, respectively to form a hinge that defines a pivot axis such that the first and second tray portions are selectively rotatable relative to each other about the hinge. The end cap can have an end cap body including a series of upper legs and a series of lower legs. The portable standing desk is selectively and alternatively movable between A) a storage position, wherein in the storage position the first tray portion, the second tray portion and the end cap all engage each other and attain a position such that (i) the respective inside surfaces oppose each other, (ii) the first plurality of fingers and the second plurality of landing surfaces oppose the upper legs, and (iii) the second plurality of fingers and the first plurality of landing surfaces oppose the lower legs; and B) a first use position, wherein in the first use position, (i) the first plurality of engaging tabs respectively locate into the second plurality of coupling channels causing a respective interference fit therebetween, and (ii) the second plurality of engaging tabs respectively locate into the first plurality of coupling channels causing an interference fit therebetween.

In other features, the end cap defines windows formed on the upper and lower legs. The windows are configured to accommodate the first and second plurality of engaging tabs in the storage position. The first and second tray portions both define first and second pairs of blind bores therein, the first blind bores configured to selectively receive support legs in the first use position. The end cap can further include a series of detents extending from the lower legs. In the storage position, the series of detents locate into complementary first grooves defined on the first tray portion. The first tray portion can include a first series of ramps extending between the first series of tracks and the first grooves. Detents of the end cap slidably traverse along the respective first series of tracks prior to positively locating into the respective first grooves in the storage position.

According to additional features, in the first use positon, the end cap is located into positive engagement with and extends a distance away from the second tray portion, wherein the upper and lower legs of the end cap oppose the second tray portion. The second tray portion is configured to receive support legs at the first and second pairs of blind bores in a second use position whereby only the second tray portion is supported in an upright position while the first tray portion is rotated about the hinge into a generally upright position.

BRIEF DESCRIPTION OF THE DRAWINGS

The present disclosure will become more fully understood from the detailed description and the accompanying drawings, wherein.

DETAILED DESCRIPTION

As will become appreciated from the following discussion, the present disclosure provides a portable standing desk that is easily movable between a storage position and various use positions. In the storage position, the portable standing desk occupies a size that can be easily accommodated into a standard backpack or work bag. In one use position, the portable standing desk expands to provide a pair of dedicated working surfaces disposed on a respective pair of tray portions to support the use of books, papers and/or a personal computing device such as a tablet or laptop computer. In another use position, the portable standing desk expands to provide a single working surface from one tray portion where conditions may not be able to fully accommodate expansion of the portable desk for use with both of the working surfaces. The portable standing desk further provides telescoping legs that allow the user to adjust a working height of the portable standing desk according to a given situation. The portable standing desk includes a multifunctional end cap that interconnects to the first and second tray portions in the storage position as well as interconnects to one of the tray portions in a use position to offer a pocket that accepts various accessories such as a cellular phone, tablet, clipboard or other devices. As will be described herein, the pocket of the end cap is configured to orient such accessories in an upright, easily viewable and useable position.

Figure 1:
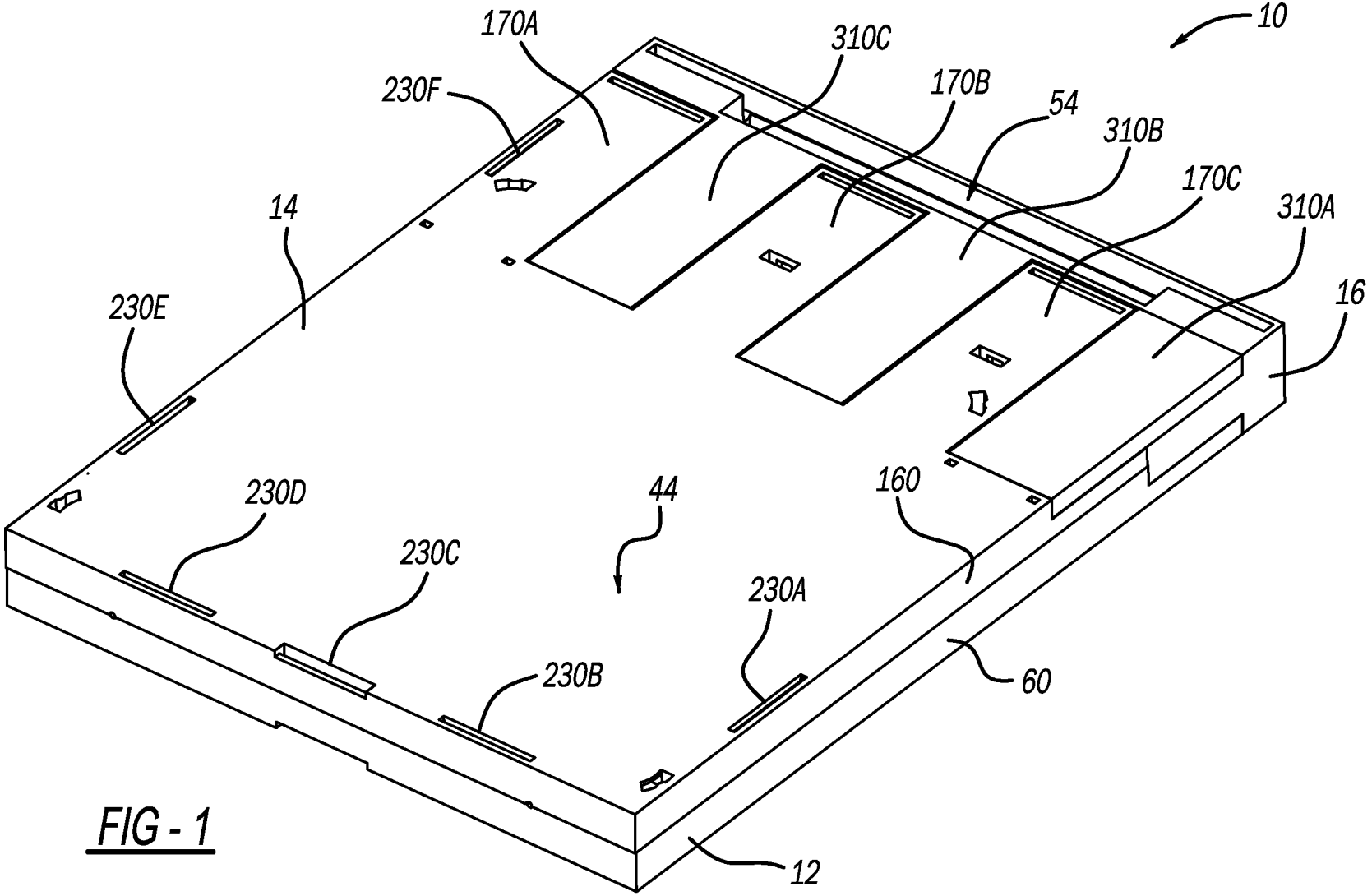
FIG. 1 is a top perspective view of a portable standing desk constructed in accordance to one example of the present disclosure and shown in a storage position.
Figure 2:
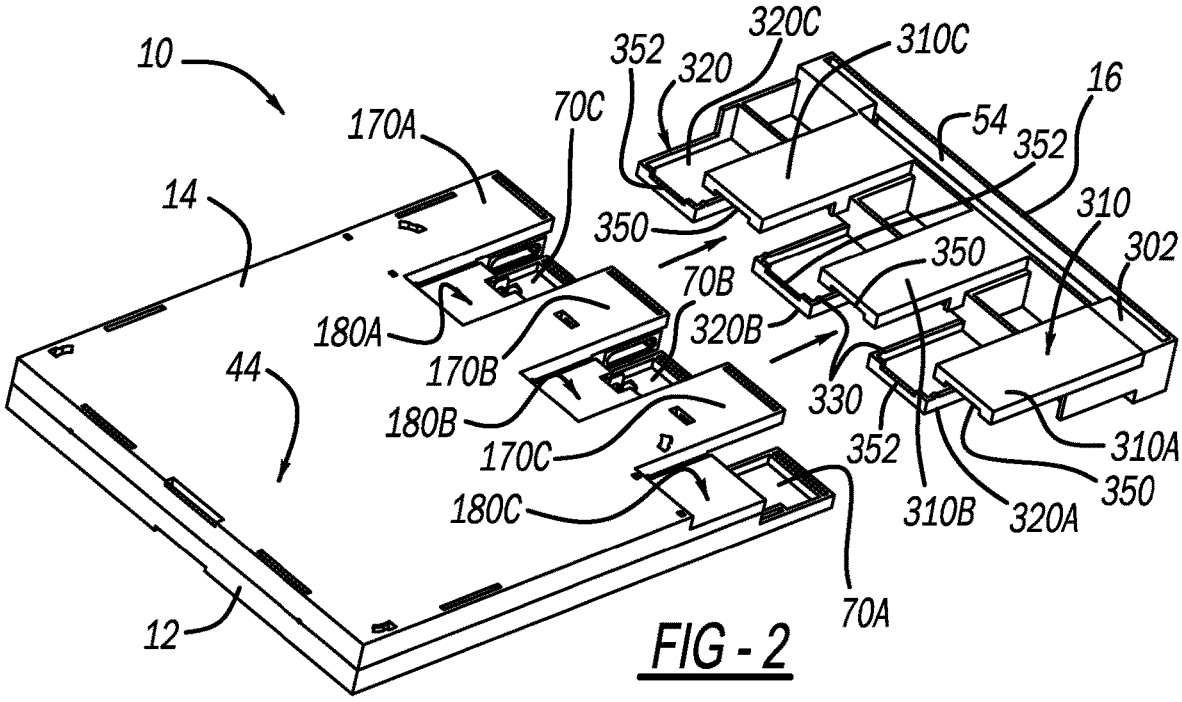
FIG. 2 is a top perspective view of the portable standing desk of FIG. 1 and shown with an end cap removed from first and second tray portions during a first expanding sequence step taken during moving the portable standing desk from the storage position of FIG. 1 to a first use position of FIG. 9.
Figure 3:
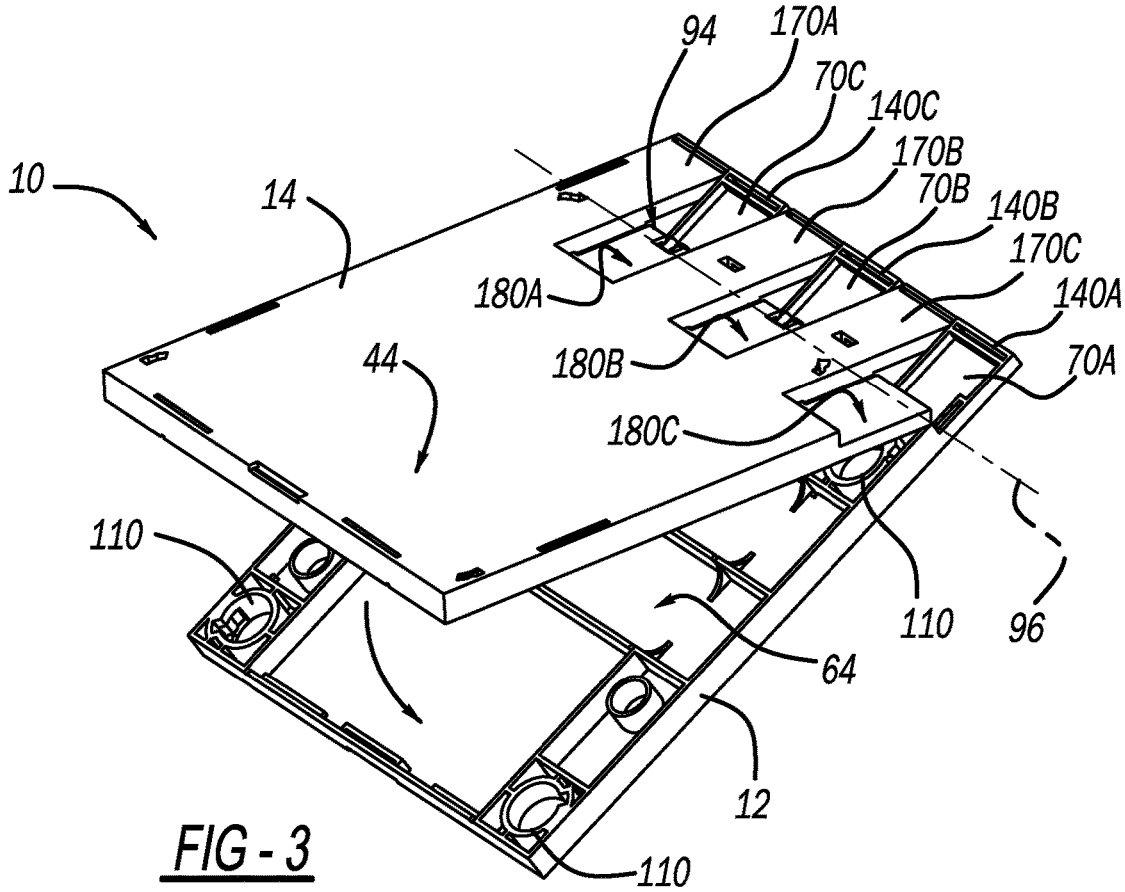
FIG. 3 is a top perspective view of the first tray portion rotating relative to the second tray portion during a second expanding sequence step taken during moving the portable standing desk from the position shown in FIG. 2 to the first use position of FIG. 9.
Figure 9:
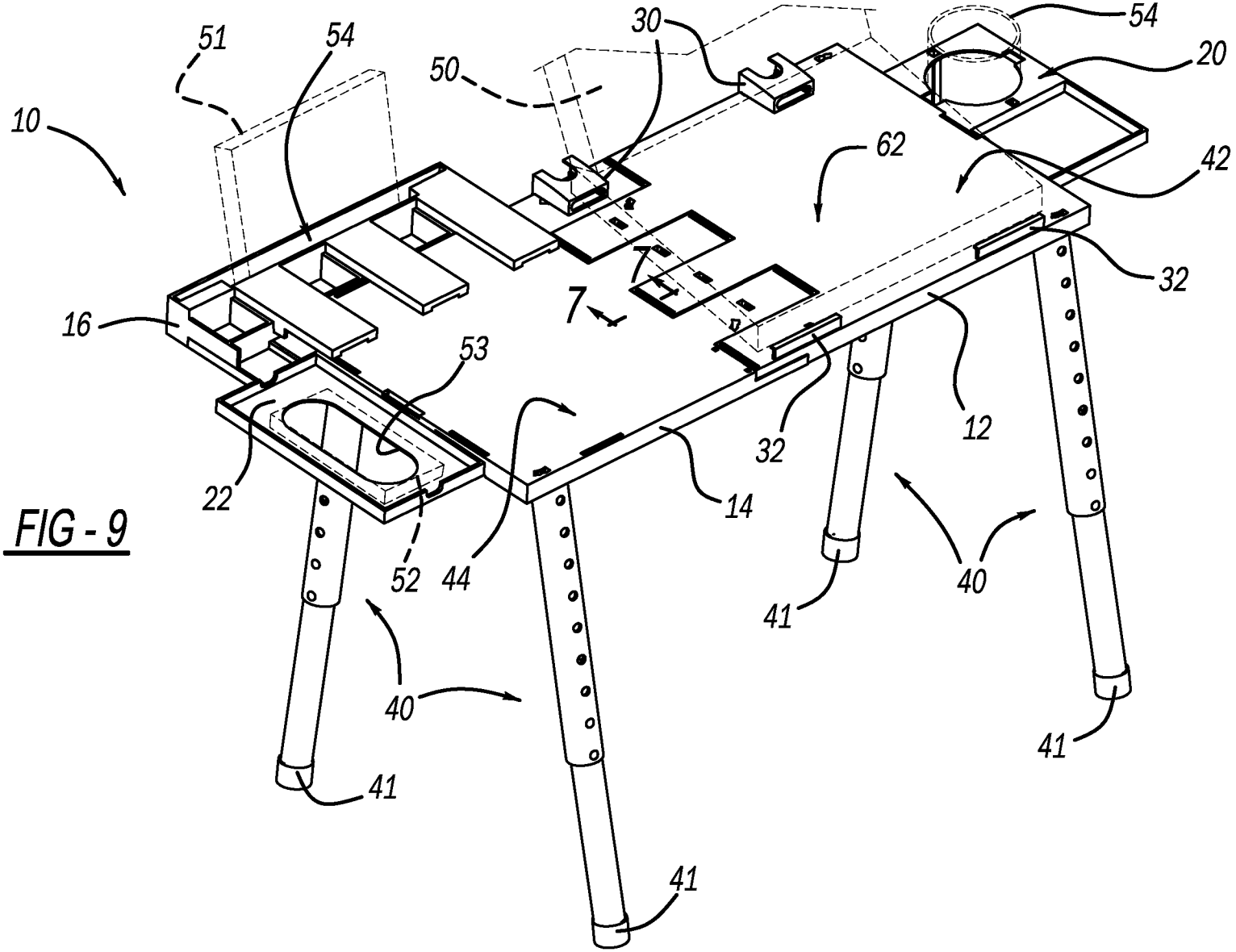
FIG. 9 is a top perspective view of the portable desk of FIG. 1 and shown in a first use position.

With initial reference to FIGS. 1 and 9, the portable storage desk constructed in accordance to one example of the present disclosure is shown and generally identified at reference 10. The portable storage desk 10 is shown in a storage position in FIG. 1 and in a first use position in FIG. 9. The portable storage desk 10 generally comprises a first tray portion 12, a second tray portion 14, an end cap 16, a beverage tray assembly 20, an accessory tray 22, angling blocks, collectively identified at reference 30, stops, collectively identified at reference 32 and support legs, collectively identified at reference 40.

With particular reference now to FIG. 1, the portable storage desk 10 can achieve a very compact size and footprint in the storage position where features of the end cap 16 interconnect with complementary features on the first and second tray portions 12, 14 in a robust, rigid manner that is easy for transport. As will be described, the remaining components are stored in a secure manner between the first and second tray portions 12, 14. In this regard, the only components of the portable storage desk 10 that are exposed in the storage position are the first and second tray portions 12, 14 and the end cap 16. The interconnecting manner of the first and second tray portions 12, 14 and the end cap 16 in the storage position offers a particularly durable assembly that can withstand normal wear and tear that may be experienced during transportation.

Turning now to FIG. 9, the portable storage desk 10 is shown in a first use position. In the first use position, the end cap 16 is removed from engagement with the first and second tray portions 12, 14. The first tray portion 12 is rotated relative to the second tray portion 14 to create a pair of laterally adjacent working surfaces 42, 44. The end cap 16 is advanced into an engaged position with the second tray portion 14. In the example shown in FIG. 9, a personal computer 50 is shown placed on the working surface 42 of the first tray portion 12. A tablet or clipboard 51 is shown received by a pocket 54 defined in the end cap 16. A cellular phone 52 is shown accommodated at the tray 22. Notably, the tray 22 incorporates an opening 53 that may accommodate any extensions (e.g. pop sockets, etc.). The angling blocks 30 are located on the first tray 12 to tilt the personal computer 50 toward the user. The stops 32 are located relative to the first tray 12 to assist in securing the personal computer 50 in a fixed position at the working surface 42 to inhibit sliding of the personal computer 50. The beverage tray assembly 20 is shown coupled to the first tray portion 12 and supporting a beverage 54. The accessory tray 22 is shown coupled to the second tray portion. The legs 40 are shown coupled to the first and second tray portions 12, 14 with leg caps 41 thereon and extended to one operating height. It will be appreciated that the portable standing desk 10 can be used as a food tray for an individual wanting to work or eat while lying down (e.g. in bed, etc.).

With reference to FIGS. 1-6, 12 and 13 additional features of the first tray portion 12 will be described. It will be appreciated that the second tray portion 14 is identically constructed. In this regard, the portable standing desk 10 provides manufacturing efficiencies in that both of the first and second tray portions 12 and 14 can be formed from common tooling. In one non-limiting example, the components of the portable standing desk 10 are formed from durable light weight plastic. The first tray portion 12 generally comprises a main body 60 having an outside surface 62 (FIG. 4B) and an inside surface 64 (FIG. 4A). The main body 60 includes a first plurality of fingers collectively identified at reference 70 and individually identified at references 70A, 70B and 70C. A first plurality of landing surfaces, collectively identified at reference 80 (FIGS. 4A and 4B) and individually identified at references 80A, 80B and 80C are alternately located between adjacent fingers of the plurality of fingers 70. The landing surfaces 80A, 80B and 80C are defined on the outside surface 62 of the main body 60 of the first tray portion 12.

Figure 4A:
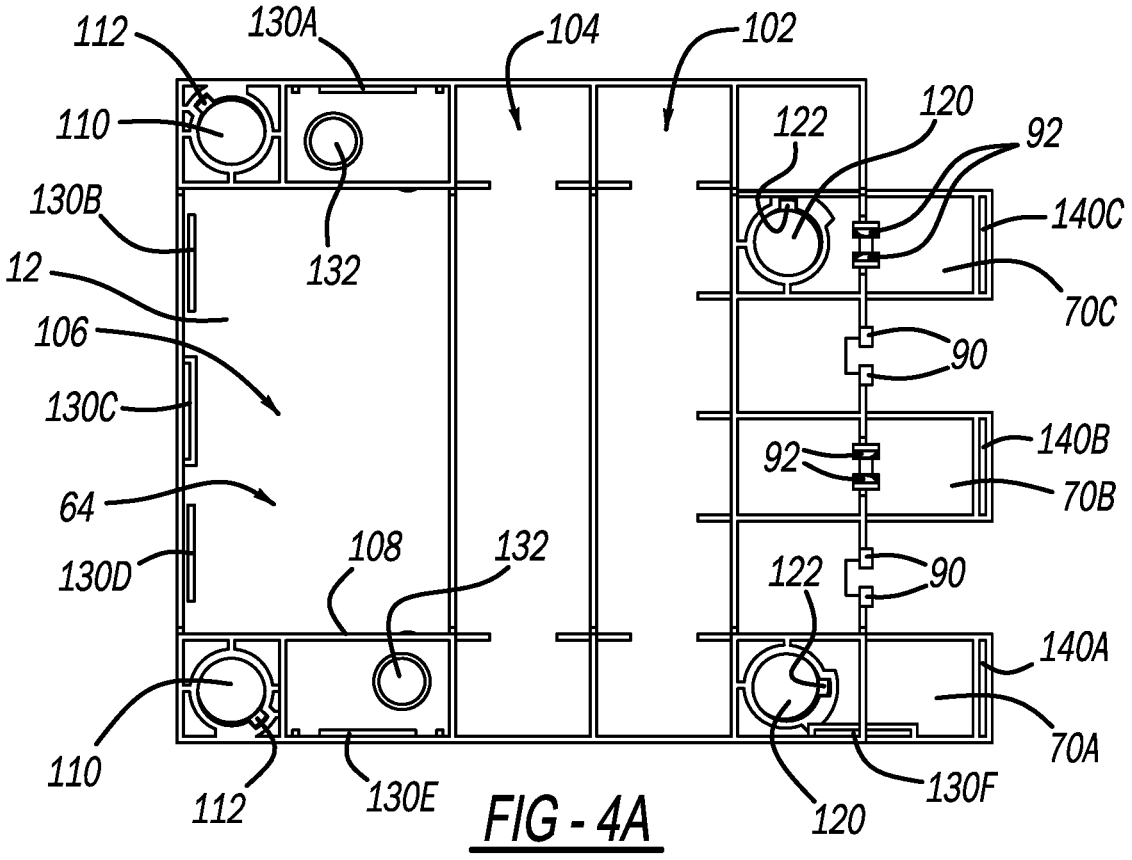
FIG. 4A is a bottom plan view of the first tray portion.

The main body 60 further includes two first pairs of hinge posts 90 and two first pairs of guide arms 92 (FIG. 4A). As will be described herein, hinge posts of the first tray portion couple to guide arms of the second tray portion. Similarly, hinge posts of the second tray portion couple to guide arms of the first tray portion. The hinge posts and guide arms collectively provide a hinge 94 that allows for rotation of the first tray portion 12 relative to the second tray portion 14 about a pivot axis 96 (FIG. 3) defined through the hinge posts.

Figure 10:
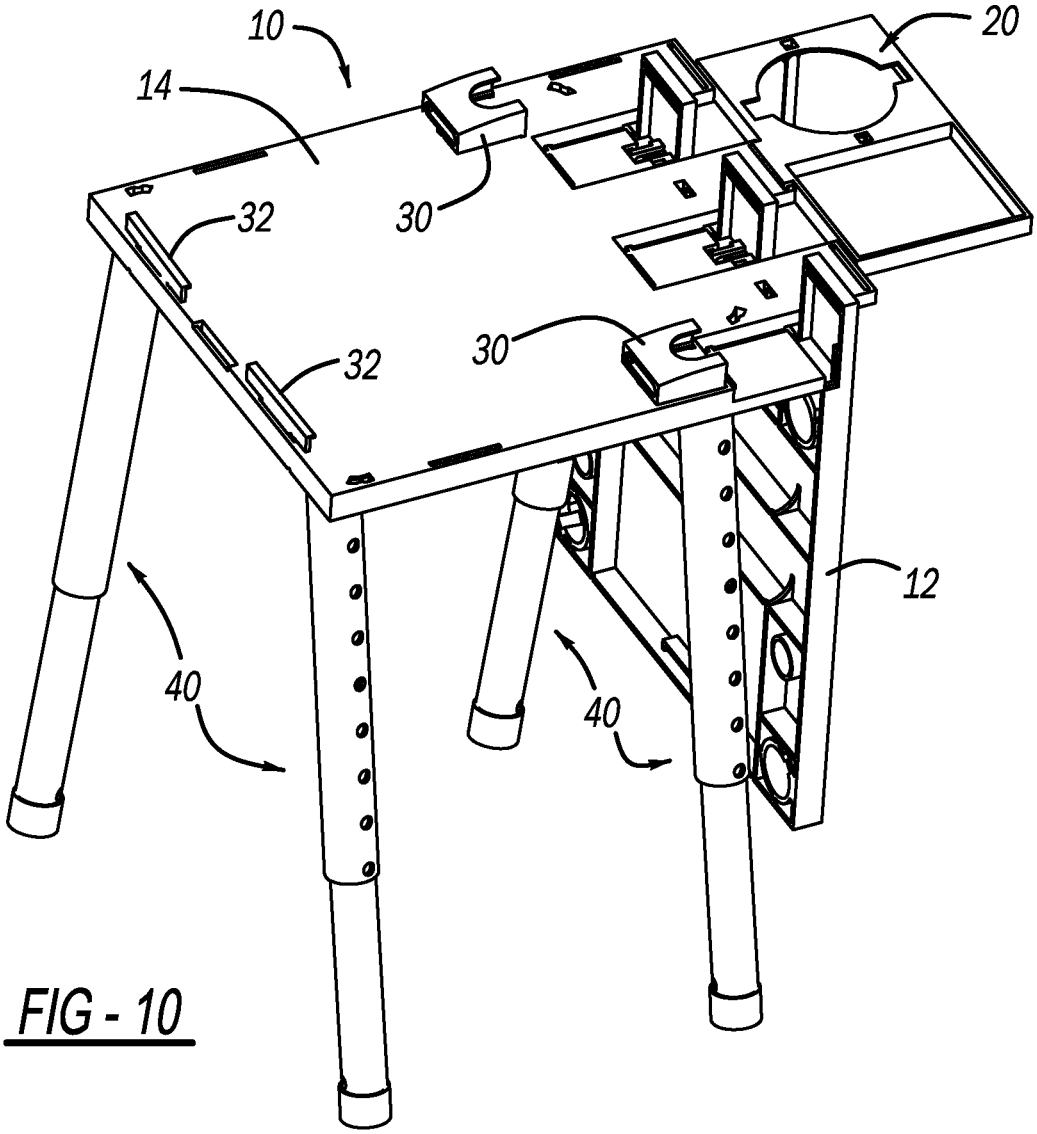
FIG. 10 is a top perspective view of the portable standing desk of FIG. 1 and shown in a second use position.

The main body 60 defines a first pocket 102 (FIGS. 4A and 13), a second pocket 104 and a third pocket 106. The third pocket 106 is bound on opposite sides by support walls 108. The first and second pockets 102, 104 can receive the legs 40 in the storage position. The third pocket 106 can receive the beverage tray assembly 20. The main body 60 can define a pair of first blind bores, collectively identified at 110 that can selectively receive portions of the support legs 40 in any of the use positions. Each first blind bore 110 can define a keyway 112 configured to receive a peg extending from a respective support leg 40 such that the peg can be initially advanced into the keyway 112 and be locked into the keyway 112 subsequent to rotation of the support leg 40 about its axis. The main body 60 can also define a pair of second blind bores 120. Each second blind bore 120 can define a keyway 122 configured to receive a peg extending from a respective support leg as described above. The pair of second blind bores 120 can be used when it is desirable to support only one of the trays in an upright position (see FIG. 10). The configuration shown in FIG. 10 can be advantageous in smaller space environments where it is not suitable to extend both of the first and second tray portions 12, 14 in a horizontal use position. The configuration shown in FIG. 11 can be used where a user wishes to use the portable storage desk in a standup configuration. In a standup configuration, longer or further telescoping legs in addition to or in place of legs 40 can be used. In some examples, such additional telescoping legs may be attached by way of the same snap button arrangement to the legs 40. It will be appreciated that in some examples, longer legs may not necessarily be accommodated within the portable storage desk 10 in the storage position.

Figure 4B:
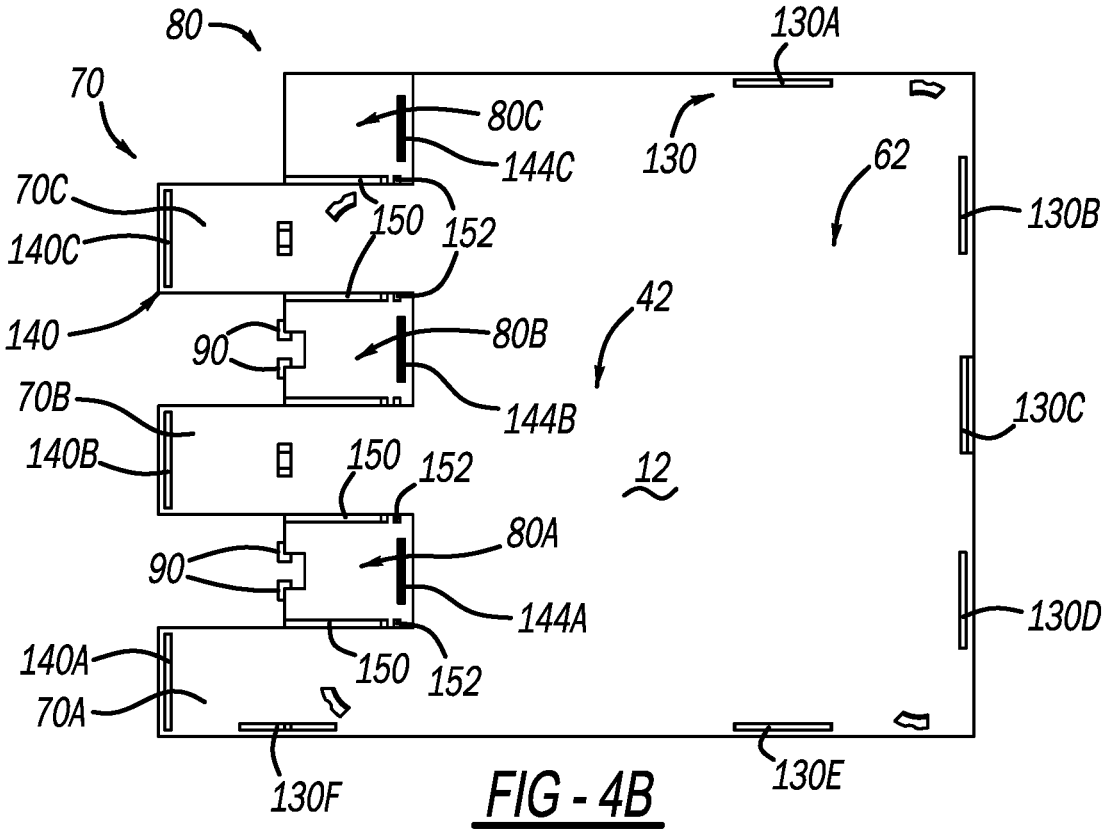
FIG. 4B is a top plan view of the first tray portion.
Figure 11:
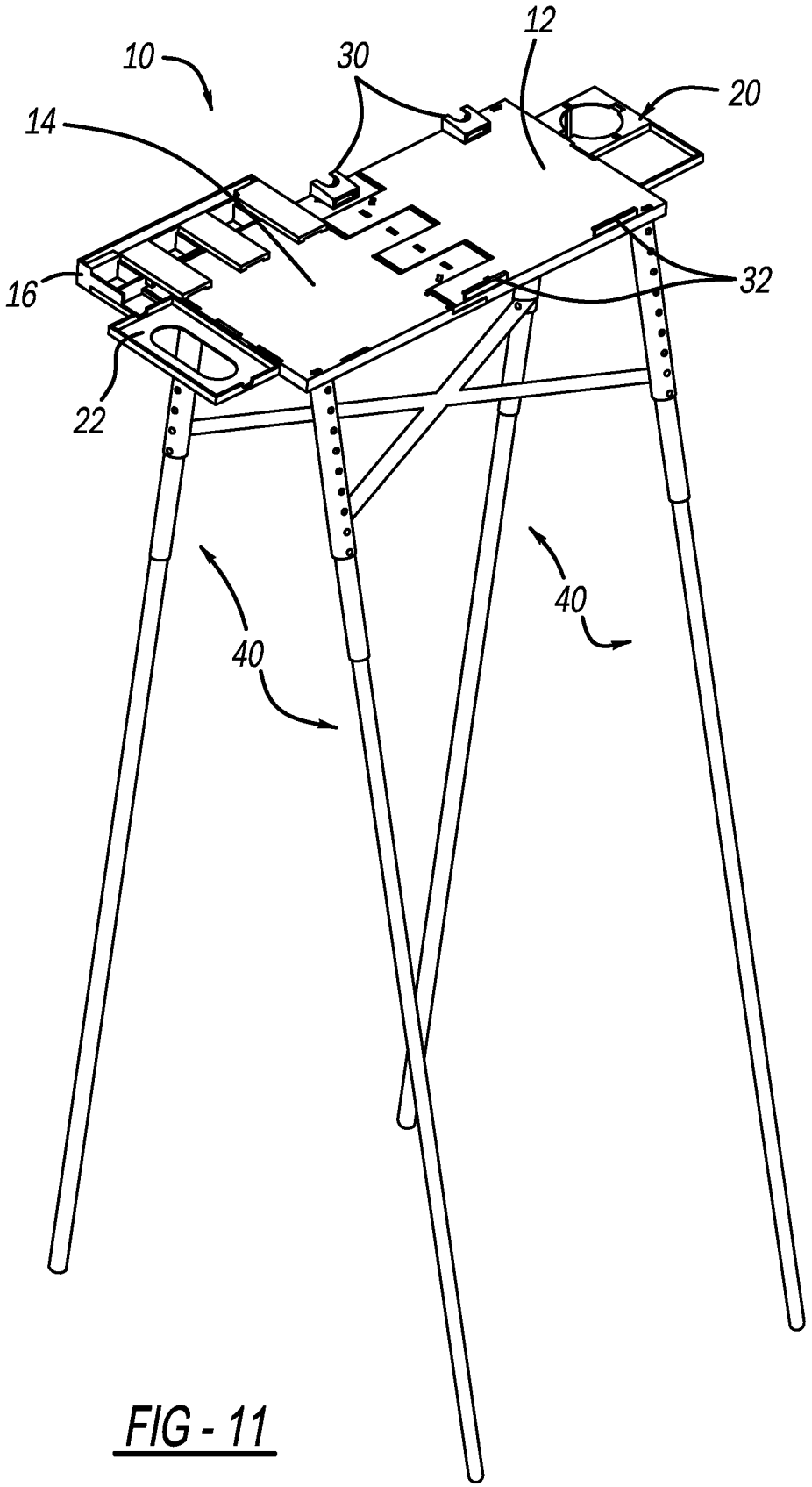
FIG. 11 is a top perspective view of the portable desk of FIG. 1 and shown in a third use position.
Figure 12:
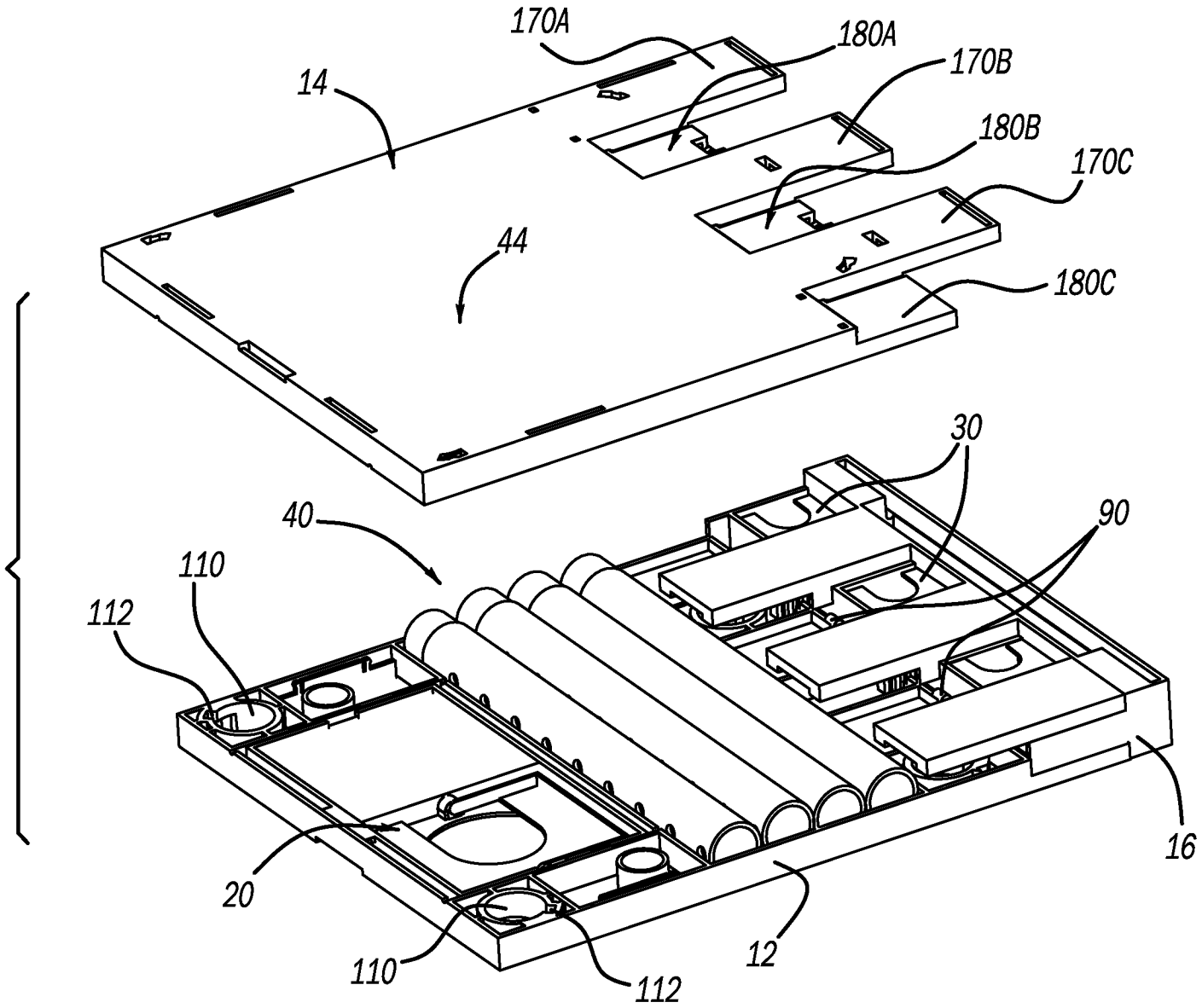
FIG. 12 is a top perspective exploded view of the first and second tray portions shown with support legs assemblies, angling blocks and a beverage tray partially nested within the second tray portion.
Figure 13:
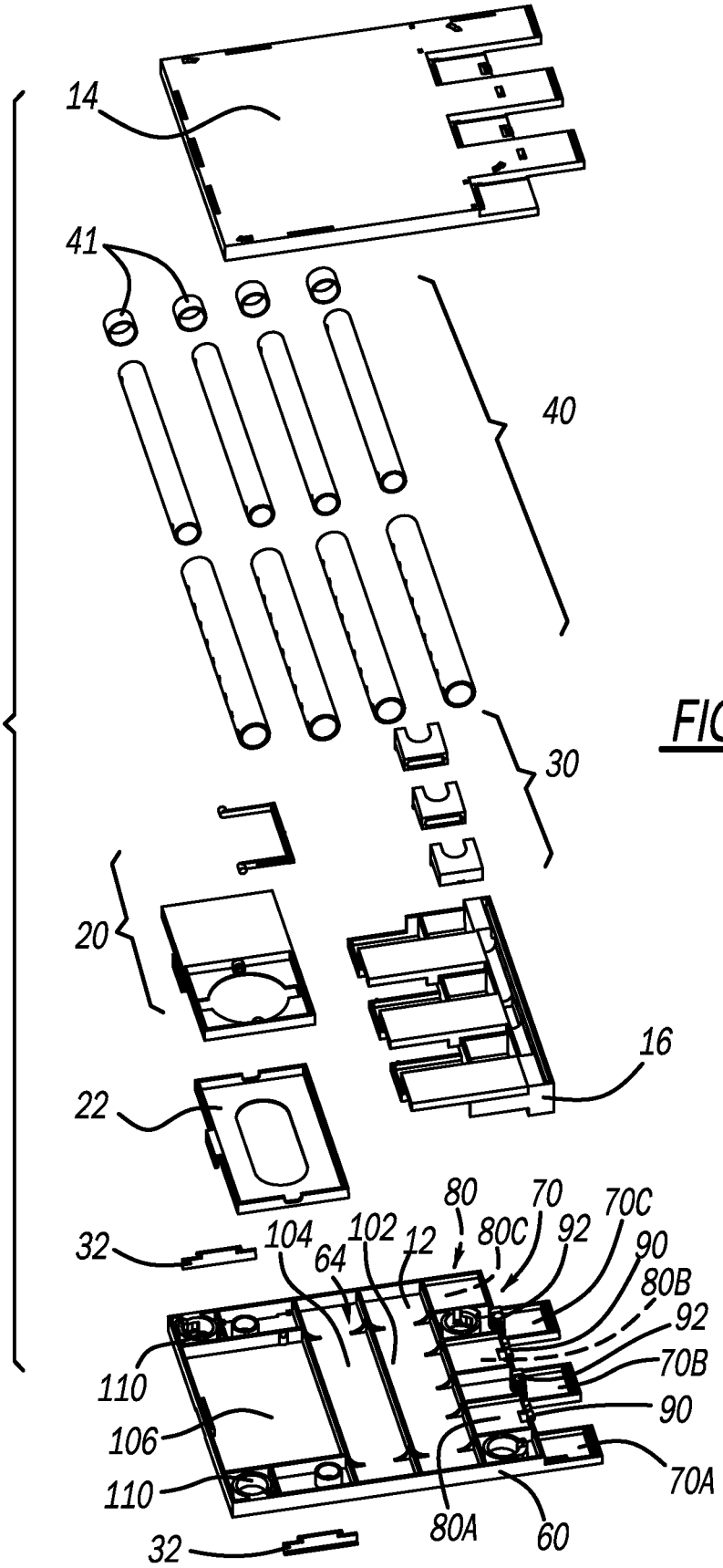
FIG. 13 is a top perspective exploded view of the first and second tray portions, the end cap, the angling blocks, the beverage tray, a swing arm for the beverage tray, an accessory tray, stops and the support leg assemblies shown in exploded view.
Figure 14:
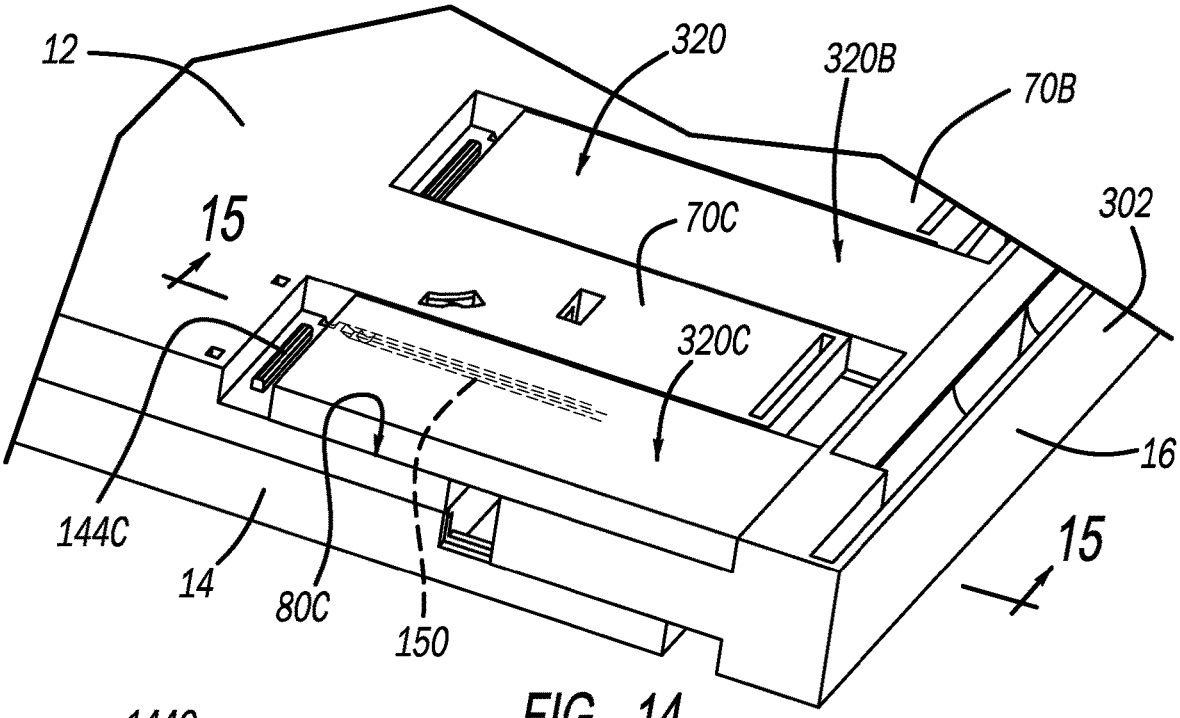
FIG. 14 is a partial bottom perspective view of the portable tray shown with the end cap partially offset away from the first and second tray portions during a first storage sequence step.
Figure 15:
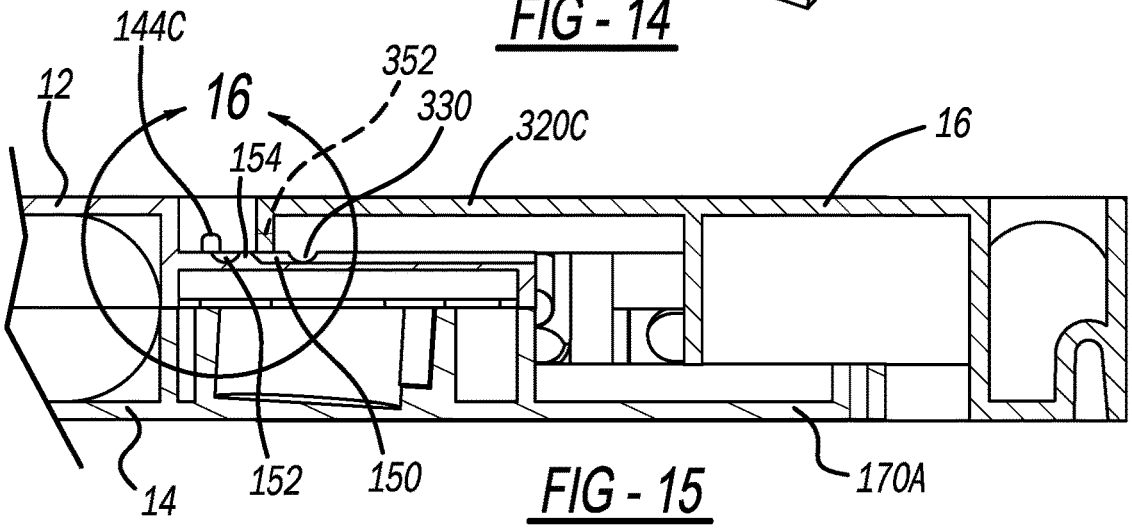
FIG. 15 is a sectional view taken along lines 15-15 of FIG. 14 showing a detent extending from the end cap displaced from a groove defined on the first tray portion, the detent sliding along a track defined on the first tray portion during the first storage sequence step.
Figure 16:
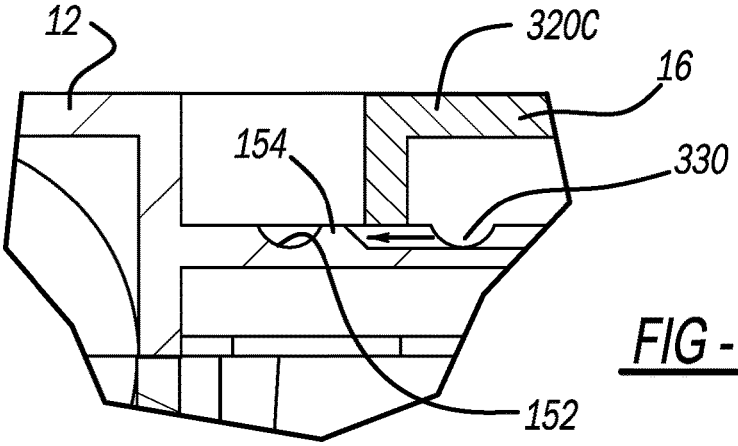
FIG. 16 is a detail view of FIG. 15.
Figure 17:
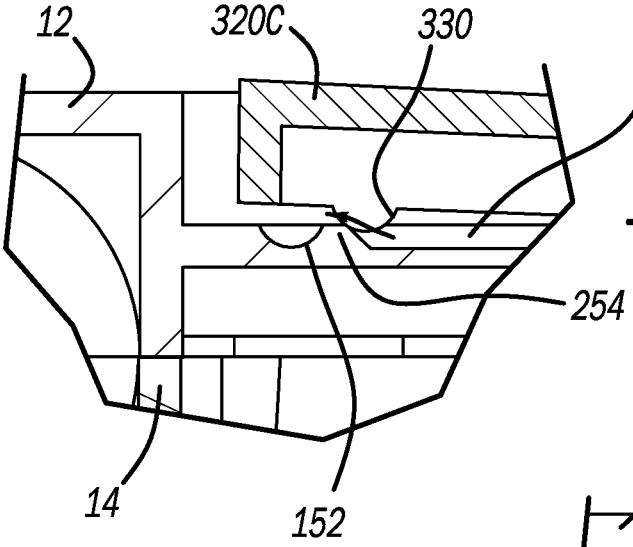
FIG. 17 is a sectional view of FIG. 16 and shown during a second storage sequence step where the detent rides over a ramp.
Figure 18:
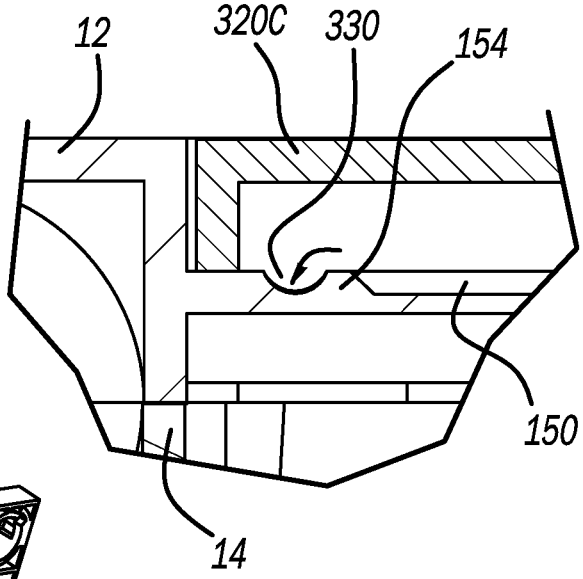
FIG. 18 is a sectional view of FIG. 17 and shown during a third storage sequence step where the detent positively locates into the groove completing the assembly of the end cap into the storage position.
Figure 19:
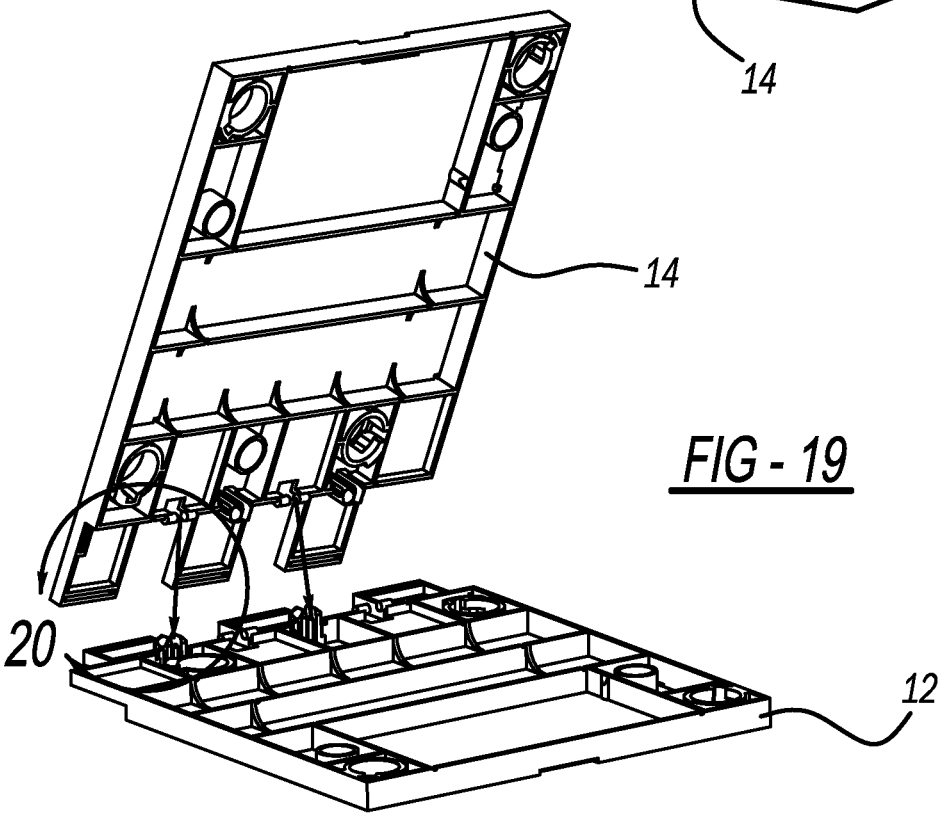
FIG. 19 is a top perspective view of the first and second tray portions shown during hinge coupling sequence.
Figure 20:
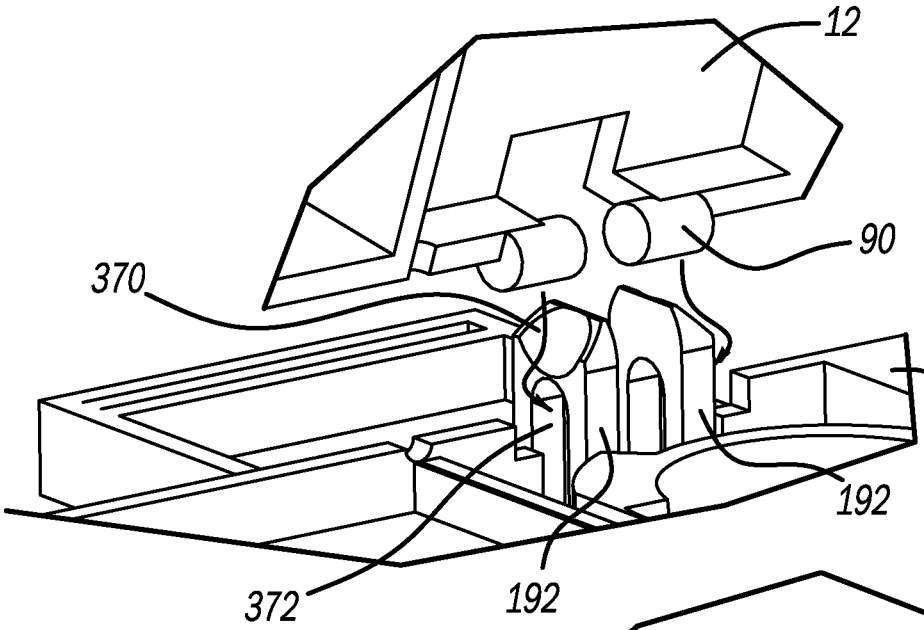
FIG. 20 is a detail view of hinge posts extending from the second tray portion being initially aligned for receipt by complementary receiving channels provided on guide arms extending from the first tray portion.
Figure 21:
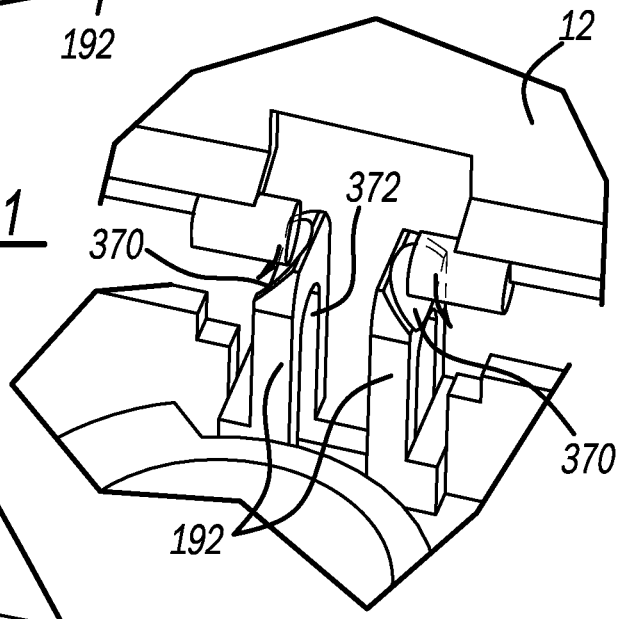
FIG. 21 is a detail view of the hinge posts slidably engaging distal guide surfaces on the guide arms.

With continued reference to FIGS. 4A and 4B, the first tray portion 12 will be further described. A series of first connecting slots, collectively identified at reference 130 and individually identified at reference 130A, 130B, 130C, 130D, 130E and 130F are arranged around a perimeter of the first tray portion 12. A pair of standoffs 132 are defined on the inside surface 64. The standoffs 132 can mount a pair of the leg caps 41 thereon such as when the leg caps 41 are removed for accommodating longer legs (FIG. 11). A series of first coupling channels, collectively identified at reference 140 and individually identified at reference 140A, 140B and 140C are defined in the respective first plurality of fingers 70A, 70B and 70C. A series of first engaging tabs, collectively identified at reference 144 and individually identified at reference 144A, 144B and 144C extend from the respective landing surfaces 80A, 80B and 80C. A series of tracks 150 and grooves 152 are defined in the first tray 12. As will be described herein, the tracks 150 and grooves 152 cooperate to receive features of the end cap 16 in the storage position.

Figure 4C:
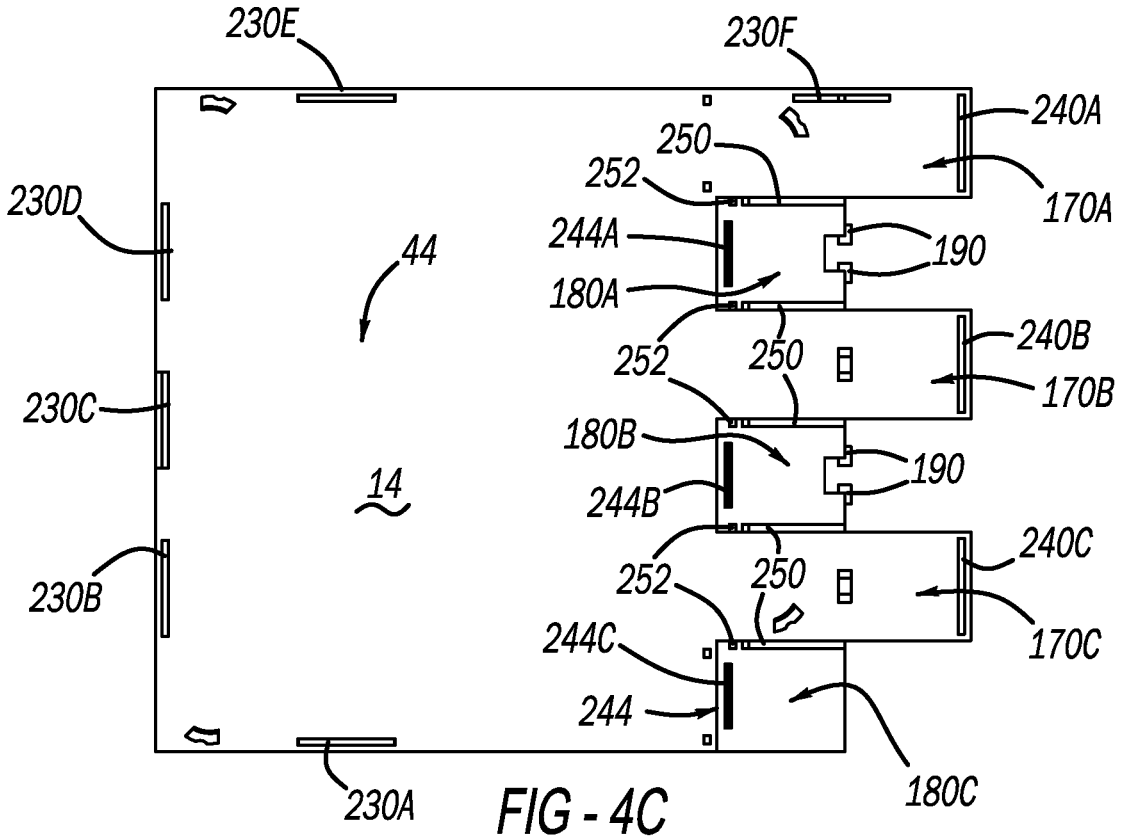
FIG. 4C is a top plan view of the second tray portion.
Figure 4D:
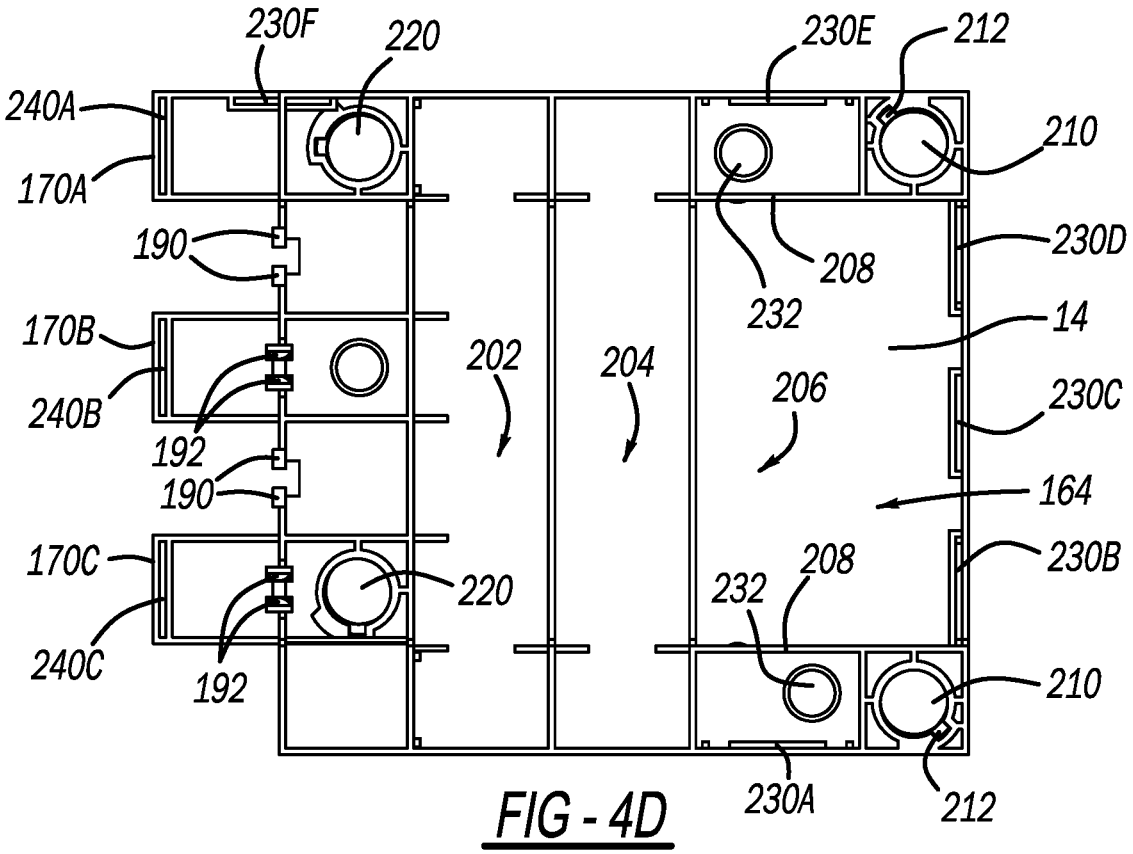
FIG. 4D is a bottom plan view of the second tray portion.
Figure 5:
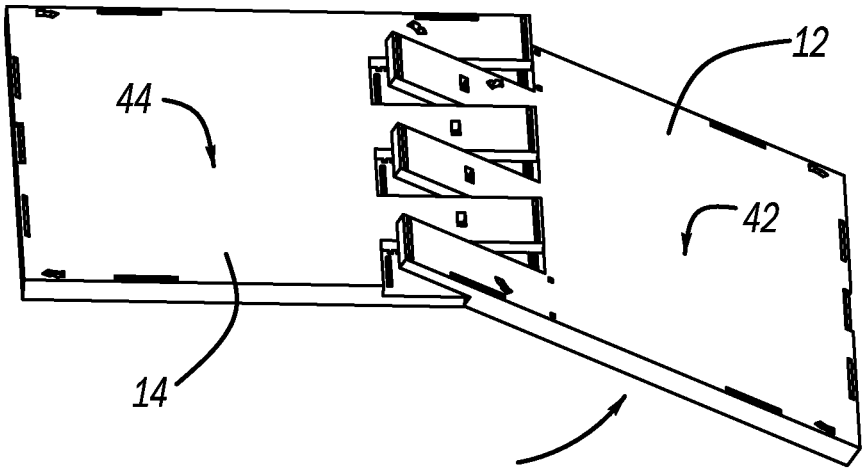
FIG. 5 is a top perspective view of the first tray portion further rotating relative to the second tray portion during a continuation of the second expanding sequence step of FIG. 3.
Figure 6:
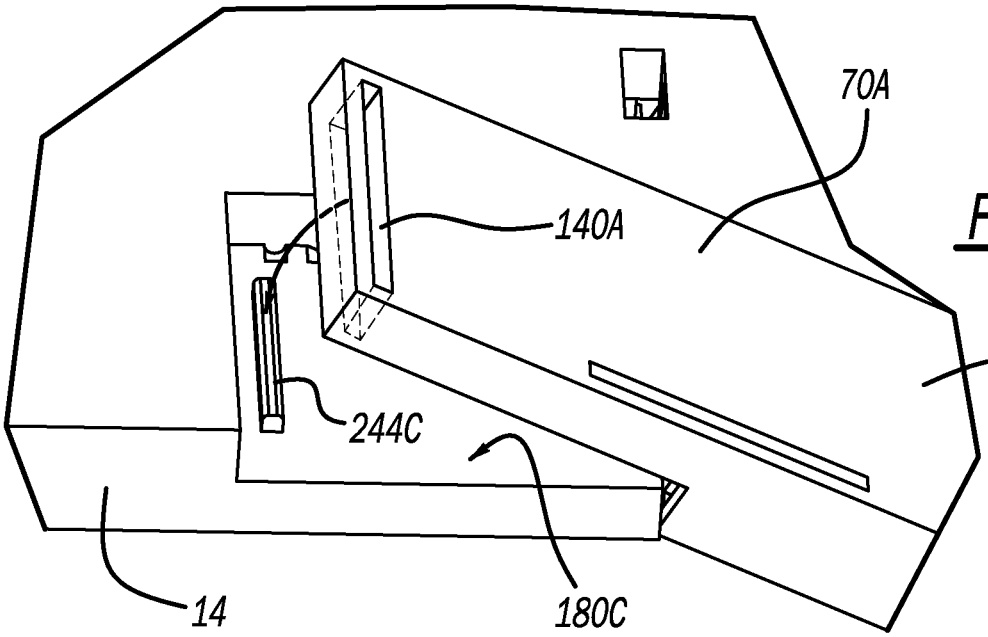
FIG. 6 is a partial top perspective view of the first tray portion positively coupling to the second tray portion during a third expanding sequence step taken during moving the portable standing desk from the storage position of FIG. 1 to the first use position of FIG. 9.
Figure 7:
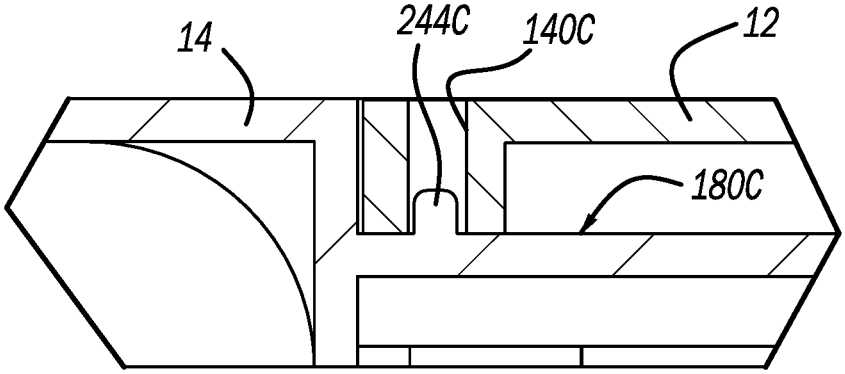
FIG. 7 is a sectional view taken along lines 7-7 of FIG. 9 shown subsequent to completion of the third expanding sequence step where the first and second tray portions are positively coupled.
Figure 8:
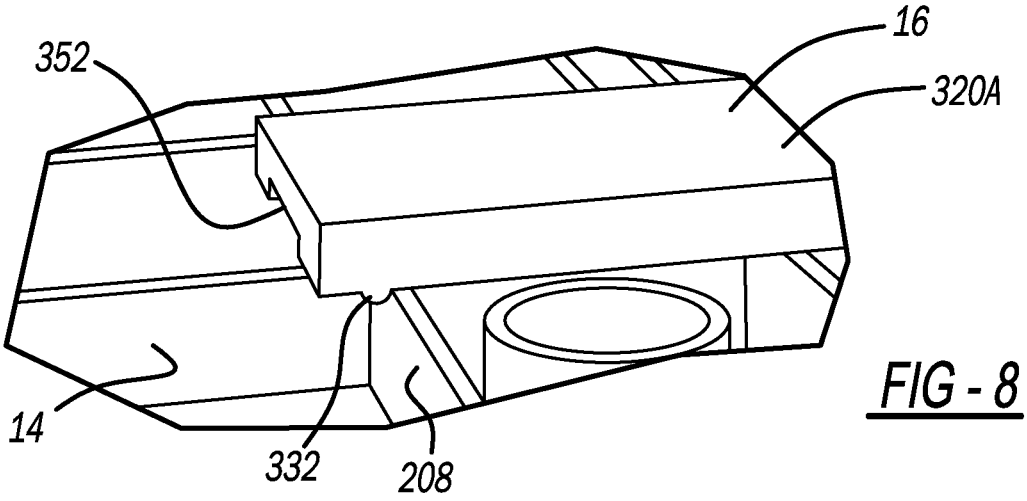
FIG. 8 is a partial bottom perspective view of a portion of the end cap shown positively locating relative to the second tray portion subsequent to a fourth expanding sequence step where the end cap is positively located onto the second tray portion in the first use position of FIG. 9.

With particular reference to FIGS. 4C and 4D, the second tray portion 14 will be described. As identified above, the second tray portion 14 is identical to the first tray portion 12. For ease of description, like reference numbers, increased by 100 will be used to denote like features on the second tray portion 14 relative to the first tray portion 12.

The second tray portion 14 generally comprises a main body 160 having an outside surface 162 (FIG. 4C) and an inside surface 164 (FIG. 4D). The main body 160 includes a second plurality of fingers collectively identified at reference 170 and individually identified at references 170A, 170B and 170C. A second plurality of landing surfaces, collectively identified at reference 180 and individually identified at references 180A, 1806 and 180C are alternately located between adjacent fingers of the plurality of fingers 170. The landing surfaces 180A, 1806 and 180C are defined on the outside surface 162 of the main body 60 of the second tray portion 14.

The main body 160 further includes two first pairs of hinge posts 190 and two first pairs of guide arms 192 (FIG. 4D). The main body 160 defines a first pocket 202, a second pocket 204 and a third pocket 206. The third pocket 206 is bound on opposite sides by support walls 208. The first and second pockets 202, 204 (along with the first and second pockets 102, 104 of the first tray portion 12) can receive the legs 40 in the storage position. The third pocket 206 can receive the beverage tray assembly 20. The main body 160 can define a pair of first blind bores, collectively identified at 210 that can selectively receive portions of the support legs 40 in any of the use positions. Each first blind bore 210 can define a keyway 212 configured to receive a peg extending from a respective support leg 40 such that the peg can be initially advanced into the keyway 212 and be locked into the keyway 212 subsequent to rotation of the support leg 40 about its axis. The main body 160 can also define a pair of second blind bores 220. Each second blind bore 220 can define a keyway 222 configured to receive a peg extending from a respective support leg as described above. The pair of second blind bores 220 can be used when it is desirable to support only one of the trays in an upright position (see FIG. 10).

A series of first connecting slots, collectively identified at reference 230 and individually identified at reference 230A, 230B, 230C and 230D are arranged around a perimeter of the second tray portion 14. A pair of standoffs 232 are defined on the inside surface 164. The standoffs 232 can mount a pair of the leg caps 41 thereon such as when the leg caps 41 are removed for accommodating longer legs (FIG. 11). A series of first coupling channels, collectively identified at reference 240 and individually identified at reference 240A, 240B and 240C are defined in the respective first plurality of fingers 170A, 1706 and 170C. A series of first engaging tabs, collectively identified at reference 244 and individually identified at reference 244A, 244B and 244C extend from the respective landing surfaces 180A, 1806 and 180C. A series of tracks 150 and grooves 152 are defined in the first tray 12. Ramps 154 separate the tracks 150 and groove 152. A series of tracks 250 and grooves 252 are defined in the second tray 14. Ramps 254 separate the tracks 250 and groove 252. The tracks 250 and grooves 252 cooperate to receive features of the end cap 16 in the storage positon.

With reference now to FIGS. 1, 2 and 14-18, the end cap 16 will be further described. The end cap 16 includes an end cap body 302 having a series of upper legs, collectively identified at reference 310 and a series of lower legs, collectively identified at reference 320. The upper legs 310 are individually identified at reference 310A, 310B and 310C. The lower legs 320 are individually identified at reference 320A, 320B and 320C. The lower legs 320 have detents 330 extending therefrom. Windows 350 and 352 are defined on the respective upper and lower legs 310, 320.

Description of the portable standing desk 10 in the storage position (FIG. 1) will now be described. In the storage position, the portable standing desk takes the general shape of a square block that can fit within a standard backpack or work bag. The features of the first tray portion, the second tray portion and the end cap are specifically designed to interconnect and interlock similar to a puzzle where voids of one component are filled with features of another component. In the storage position, the first plurality of fingers 70 of the first tray portion 12 and the second plurality of landing surfaces 180 of the second tray portion 14 oppose the respective upper legs 310 of the end cap 16. Similarly, the second plurality of fingers 170 of the second tray portion 14 and the first plurality of landing surfaces 80 of the first tray portion 12 oppose the respective lower legs 320 of the end cap 16.

Movement of the end cap 16 into the storage position will now be described with reference to FIGS. 14-18. The end cap 16 can be slidably advanced leftward as viewed in FIG. 14 whereby the lower legs 320 of the end cap 16 locate between respective first plurality of fingers 70. Similarly, upper legs 310 of the end cap 16 locate between respective second plurality of fingers 170. Detents 330 slidably advance along tracks 150 of the first tray portion 12. Once the detents 330 encounter the ramps 154 (FIG. 17), the detents 330 rise over the ramps 154 and come to rest into respective grooves 152. Due to the respective detents 330 ramping over the ramps 154, the user experiences tactile feedback that the end cap 16 is sufficiently interlocked to the first and second tray portions 12, 14 in the storage position when the detents 330 complete travel over the ramps 154 and come to rest into the grooves 152. It will be appreciated that while the detents 330 have been described herein as formed on the lower legs, the detents may be alternatively or additionally formed on the upper legs.

With reference to FIGS. 19-23, additional features of the hinge 94 will be described. As mentioned above, the hinge 94 is collectively defined by the respective hinge posts 90, 190 and the guide arms 92, 192. In the regard, the hinge posts 90 of the first tray portion interconnect with the guide arms 192 of the second tray portion 14. Similarly, the hinge posts 190 of the second tray portion interconnect with the guide arms 92 of the first tray portion 12. It will be appreciated that the sequence described with respect to FIGS. 19-23 for coupling the first and second trays 12 and 14 together is preferably accomplished once. Explained further, the first and second trays 12 and 14 can be coupled together at the hinge 94 during a manufacturing step or initial assembly. Once the first and second trays 12 and 14 are hingedly coupled together, the user need not decouple the first and second trays during transitioning between the storage position and various use positions.

Figure 22:
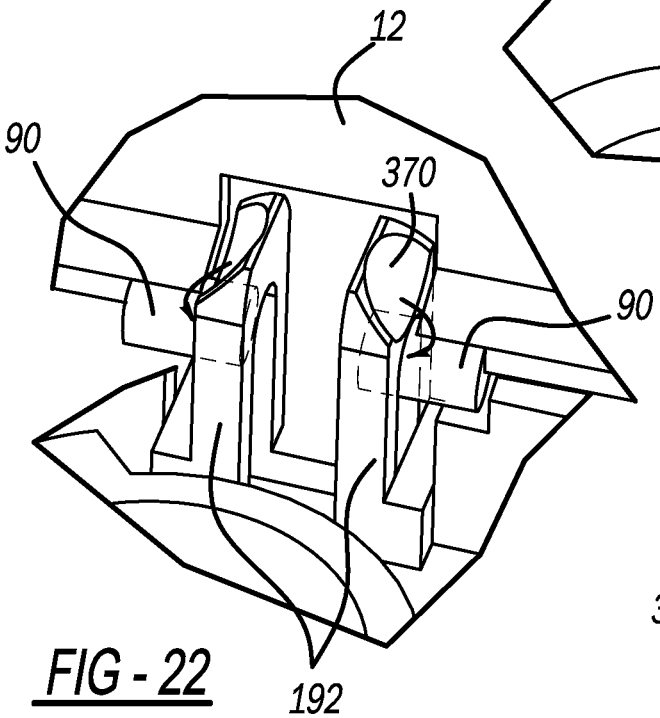
FIG. 22 is a detail view of the hinge posts further advancing along the distal guide surfaces deflecting the guide arms toward each other until the hinge posts locate into the complementary receiving channels in a hingedly coupled position.
Figure 23:
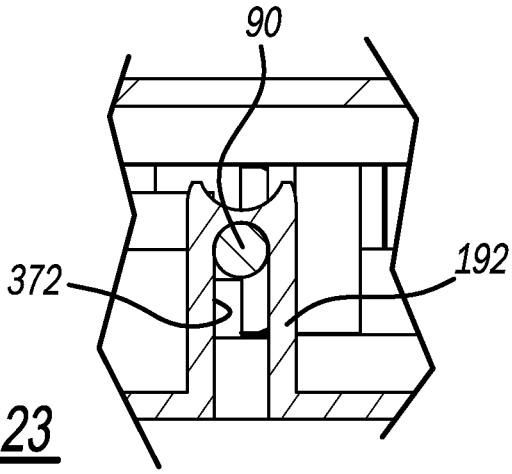
FIG. 23 is a side view of the hinge posts and guide arms of FIG. 22.

The guide arms 192 define distal guide surfaces 370. The hinge posts 90 can be advanced along the distal guide surfaces 370 causing the guide arms 192 to temporarily deflect toward each other until the hinge posts 90 locate within receiving channels 372 defined in the guide arms 192. In this regard, the guide arms 192 are configured to plastically deflect temporarily inwardly toward each other during slidable contact of the hinge posts 90 along the distal guide surfaces 170 until the hinge posts 90 have translated downwardly from the position as viewed in FIG. 21 to a position shown in FIG. 22. In FIG. 22, the hinge posts 90 locate into the receiving channels 372 upon which the guide arms 192 rebound to their original upright position.

Figure 24:
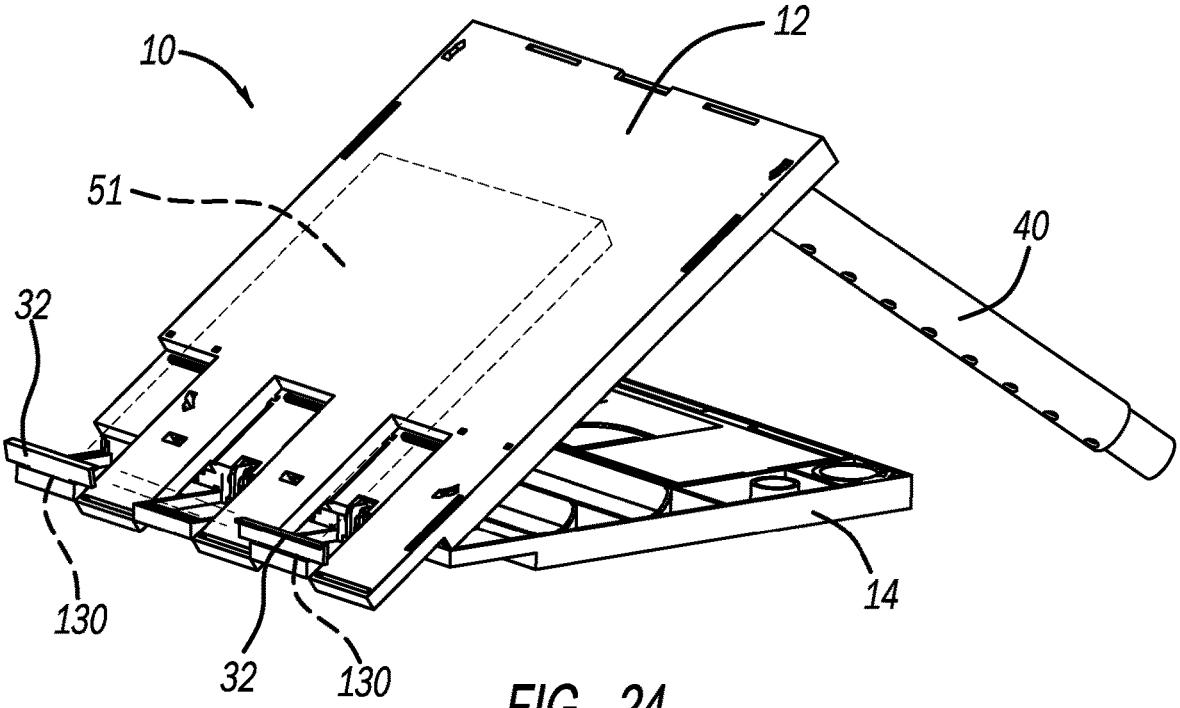
FIG. 24 is a first perspective view of the portable desk of FIG. 1 and shown in a fourth use position.
Figure 25:
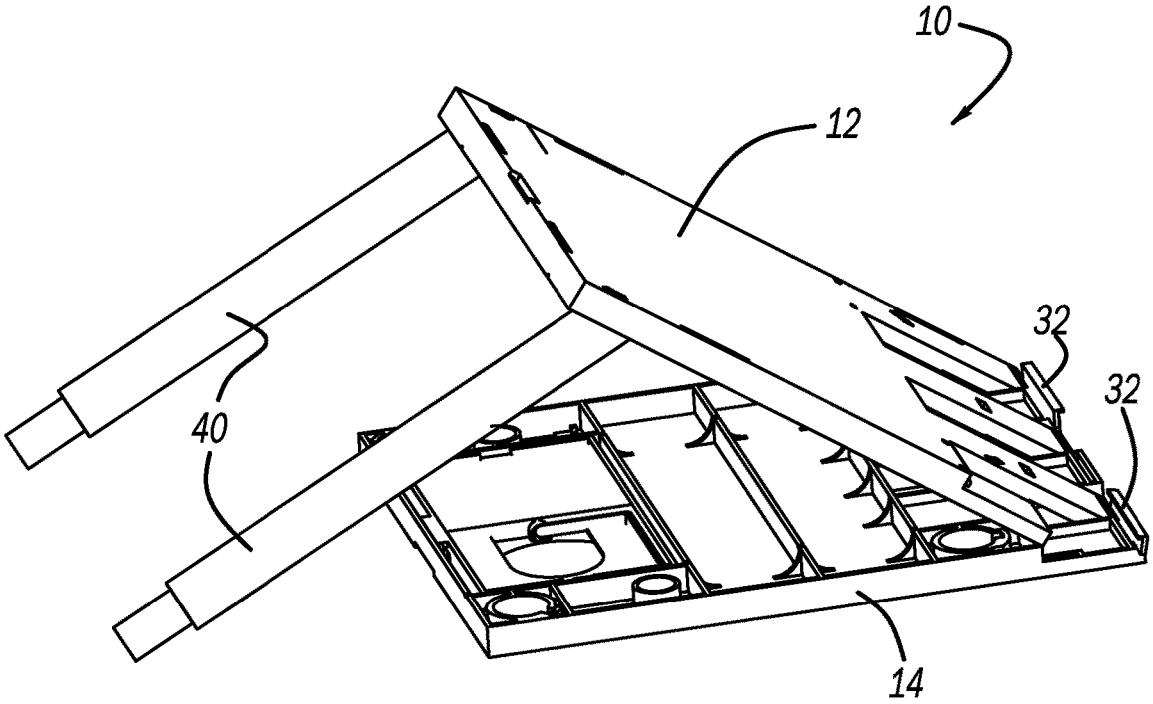
FIG. 25 is a second perspective view of the portable desk of FIG. 24.

FIGS. 24 and 25 show the portable desk 10 in a fourth use position. The fourth use position can orient the first tray portion 12 at an angle relative to the user such that a personal computing device can be placed thereon for use. In some examples, the second tray portion 14 can be supported by a table or other stationary surface. The legs 40 can be used to provide rear support for the first tray portion 12 during use in the fourth use position. In some examples, the stops 32 can be received by any of the connecting slots 130.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A portable standing desk configured for use in at least a storage position and a first use position, the portable standing desk comprising:

a first tray portion having a main body including a first plurality of fingers, a first plurality of landing surfaces, first hinge posts and first guide arms, the first tray portion having a first working surface and a first inside surface;

a second tray portion having a main body including a second plurality of fingers, a second plurality of landing surfaces, second hinge posts and second guide arms, the second tray portion having a second working surface and a second inside surface, wherein the first and second hinge posts couple with the second and first guide arms, respectively to form a hinge that defines a pivot axis such that the first and second tray portions are selectively rotatable relative to each other about the hinge; and an end cap having an end cap body including a series of upper legs, and a series of lower legs;

wherein the portable standing desk is selectively and alternatively movable between the storage position and the first use position, wherein in the storage position the first tray portion, the second tray portion and the end cap all engage each other and attain a position such that (i) the respective inside surfaces oppose each other, (ii) the first plurality of fingers and the second plurality of landing surfaces oppose the upper legs, and (iii) the second plurality of fingers and the first plurality of landing surfaces oppose the lower legs.

2. The portable standing desk of claim 1 wherein in the first use position, (i) the first plurality of fingers oppose the second plurality of landing surfaces, and (ii) the second plurality of fingers oppose the first plurality of landing surfaces.

3. The portable desk of claim 2 wherein:

the first tray portion further defines a first plurality of coupling channels formed on the first plurality of fingers and a first plurality of engaging tabs formed on the first plurality of landing surfaces;

the second tray portion further defines a second plurality of coupling channels formed on the second plurality of fingers and a second plurality of engaging tabs formed on the second plurality of landing surfaces;

wherein in the first use position, (i) the first plurality of engaging tabs locate into the second plurality of coupling channels causing an interference fit therebetween, and (ii) the second plurality of engaging tabs locate into the first plurality of coupling channels causing an interference fit therebetween.

4. The portable desk of claim 3 wherein the end cap defines windows formed on the upper and lower legs, the windows configured to accommodate the first and second plurality of engaging tabs in the storage position.

5. The portable standing desk of claim 1 wherein the end cap further comprises:

a series of detents extending from the lower legs, wherein in the storage position the series of detents locate into complementary first grooves defined on the first tray portion.

6. The portable standing desk of claim 5 wherein:

the first tray portion includes a first series of ramps extending between the first series of tracks and the first grooves; and wherein the detents of the end cap slidably traverse along the respective first series of tracks prior to positively locating into the respective first grooves in the storage position.

7. The portable desk of claim 6 wherein in the first use position the end cap is located into positive engagement with and extends a distance away from the second tray portion, wherein the upper and lower legs of the end cap oppose the second tray portion.

8. The portable desk of claim 7 wherein the lower detents positively locate against a support wall extending on the second inside surface of the second tray portion in the first use position.

9. The portable desk of claim 8 wherein the end cap defines a pocket therein, wherein the pocket is configured to receive and orient in an upright position at least one of a personal electronic device and clipboard thereat.

10. The portable desk of claim 1 wherein the first and second tray portions both define first and second pairs of blind bores therein, the first blind bores configured to selectively receive support legs in the first use position.

11. The portable desk of claim 10 wherein the second tray portion is configured to receive support legs at the first and second pairs of blind bores in a second use position whereby only the second tray portion is supported in an upright, horizontal position while the first tray portion is rotated about the hinge into a generally vertical position.

12. The portable desk of claim 1, further comprising:

an accessory tray that is received in an accessory tray pocket in the storage position and selectively coupled to the first tray portion in the first use position; and a beverage tray assembly that is received in a beverage tray pocket in the storage position and selectively coupled to the second tray portion in the first use position.

13. The portable desk of claim 1, further comprising:

a pair of angling blocks that are received in the first tray pocket in the storage position and selectively coupled to the first tray portion in the first use position, the pair of angling blocks configured to raise an orientation of a personal electronic device that is placed on the first working surface; and at least one stop that is received in the first tray pocket in the storage position and selectively coupled to the first tray portion in the first use position, the at least one stop configured to inhibit sliding of the personal electronic device relative to the first working surface.

14. A portable standing desk configured for use in at least a storage position and a first use position, the portable standing desk comprising:

a first tray portion having a main body including a first plurality of fingers that define a respective first plurality of coupling channels, a first plurality of landing surfaces that include a respective first plurality of engaging tabs, first hinge posts and first guide arms, the first tray portion having a first working surface and a first inside surface;

a second tray portion having a main body including a second plurality of fingers that define a respective second plurality of coupling channels, a second plurality of landing surfaces that include a respective second plurality of engaging tabs, second hinge posts and second guide arms, the second tray portion having a second working surface and a second inside surface, wherein the first and second hinge posts couple with the second and first guide arms, respectively to form a hinge that defines a pivot axis such that the first and second tray portions are selectively rotatable relative to each other about the hinge; and an end cap having an end cap body including a series of upper legs, and a series of lower legs;

wherein the portable standing desk is selectively and alternatively movable between:

A) a storage position, wherein in the storage position the first tray portion, the second tray portion and the end cap all engage each other and attain a position such that (i) the respective inside surfaces oppose each other, (ii) the first plurality of fingers and the second plurality of landing surfaces oppose the upper legs, and (iii) the second plurality of fingers and the first plurality of landing surfaces oppose the lower legs; and B) a first use position, wherein in the first use position, (i) the first plurality of engaging tabs respectively locate into the second plurality of coupling channels causing a respective interference fit therebetween, and (ii) the second plurality of engaging tabs respectively locate into the first plurality of coupling channels causing an interference fit therebetween.

15. The portable desk of claim 14 wherein the end cap defines windows formed on the upper and lower legs, the windows configured to accommodate the first and second plurality of engaging tabs in the storage position.

16. The portable desk of claim 14 wherein the first and second tray portions both define first and second pairs of blind bores therein, the first blind bores configured to selectively receive support legs in the first use position.

17. The portable standing desk of claim 14 wherein the end cap further comprises:

a series of detents extending from the lower legs, wherein in the storage position the series of detents locate into complementary first grooves defined on the first tray portion.

18. The portable standing desk of claim 17 wherein:

the first tray portion includes a first series of ramps extending between the first series of tracks and the first grooves; and wherein the detents of the end cap slidably traverse along the respective first series of tracks prior to positively locating into the respective first grooves in the storage position.

19. The portable desk of claim 18 wherein in the first use position the end cap is located into positive engagement with and extends a distance away from the second tray portion, wherein the upper and lower legs of the end cap oppose the second tray portion.

20. The portable desk of claim 19 wherein the second tray portion is configured to receive support legs at the first and second pairs of blind bores in a second use position whereby only the second tray portion is supported in an upright, horizontal position while the first tray portion is rotated about the hinge into a generally vertical position.

* * * * *